United States Patent [19]

List et al.

[11] 4,278,055

[45] Jul. 14, 1981

[54] LOW-NOISE-LEVEL INTERNAL COMBUSTION VEE-ENGINES

[75] Inventors: Hans List, 126 Heinrichstrasse, Graz, Austria; Othmar Skatsche, Graz, Austria; Gerhard Thien, Graz, Austria; Heinz Fachbach, Graz, Austria; Josef Greier, Graz, Austria; Johann Wagner, Graz, Austria

[73] Assignee: Hans List, Graz, Austria

[21] Appl. No.: 55,521

[22] Filed: Jul. 9, 1979

Related U.S. Application Data

[62] Division of Ser. No. 877,896, Feb. 15, 1978, abandoned.

[30] Foreign Application Priority Data

Feb. 24, 1977 [AT] Austria ..... 1259/77
Oct. 24, 1977 [AT] Austria ..... 7600/77

[51] Int. Cl.[3] ..... F02B 77/00
[52] U.S. Cl. ..... 123/195 S; 123/195 R; 123/198 E

[58] Field of Search ..... 123/195 R, 195 C, 195 S, 123/198 E

[56] References Cited

U.S. PATENT DOCUMENTS

| | | | |
|---|---|---|---|
| 2,963,009 | 12/1960 | Dolza | 123/198 E |
| 3,464,398 | 9/1969 | Scheiterlein et al. | 123/198 E |
| 3,540,425 | 11/1970 | Scheiterlein et al. | 123/195 R |
| 3,684,053 | 8/1972 | Fachbach et al. | 123/198 E |
| 3,941,114 | 3/1976 | Seifert | 123/195 R |
| 3,973,548 | 8/1976 | Celli | 123/195 C |
| 4,071,008 | 1/1978 | Skatsche et al. | 123/198 E |

*Primary Examiner*—Ira S. Lazarus
*Attorney, Agent, or Firm*—Watson, Cole, Grindle & Watson

[57] ABSTRACT

Low-noise-level internal combustion Vee-engine with a skeletal engine unit support and the cylinder head mounted thereon, auxiliary units rigidly connected to the skeletal engine unit support and the cylinder head, an engine case surrounding the engine unit support and connected to same by at least one sound-absorbing member.

4 Claims, 5 Drawing Figures

LOW-NOISE-LEVEL INTERNAL COMBUSTION VEE-ENGINES

This is a division of application Ser. No. 877,896 filed Feb. 15, 1978, now abandoned .

BACKGROUND OF THE INVENTION

1. Field of the Invention

This invention relates to improvements in low-noise-level internal combustion engines, more specifically to a low-noise-level internal combustion engine of the kind having a skeletal support for the crankshaft main bearings and wherein the sound through solids stimulated parts of the engine cylinder block, cylinder head and auxiliaries rigidly secured to the cylinder head are connected together, and a composite crankcase and flywheel casing is connected to said parts by at least one sound-absorbing element.

2. Description of the Prior Art

At this construction the vibration generating parts of the engine cannot transmit the vibrations to the composite crankcase and flywheel casing because of the sound-absorbing mounting. Apart from the advantage of reduced overall weight this arrangement presents the main advantage that the crankcase and the flywheel casing require no further sound-absorbing provisions whatsoever because all of these parts are already acoustically insulated relative to the skeletal engine unit support which is itself subject to the operative forces and resulting vibrations.

In the DE-OS No. 2 612 182 an internal combustion engine of said construction is described, having the cylinders arranged in a single line.

SUMMARY OF THE INVENTION

It is the aim of the invention to provide an improvement in low-noise-level internal combustion engines which is also practicable at Vee-engines. According to the invention at a Vee-engine the connection between the skeletal support and the crankcase with the sound-absorbing element is made by means of a supporting surface arranged at and surrounding the skeletal support and a counter surface arranged at and surrounding the crankcase, both areas being plane at least in the range of the longitudinal sides of the crankcase and the skeletal support. By these means all advantages of the above mentioned construction are maintained also at Vee-engines whereby the fabrication of the connecting surface between the skeletal support and the crankcase is relatively easy.

According to another embodiment of the invention a still easier kind of fabrication is gained when the supporting surface and the counter surface for the connection of the skeletal support and the crankcase are at the front sides of said engine parts performed as cylinder areas at the crankcase and corresponding cylindrical counter areas at the skeletal support, the axes of said cylinder areas extending in the engine's plane of symmetry and parallel to the crankshaft axis. It is particularly advantageous for the fabrication of the surfaces that the axes of the cylinder areas and the crankshaft are identical.

In another arrangement of this invention the supporting surface at the skeletal support and the counter surface at the crankcase lie each within a horizontal plane above the crankshaft. The provision of horizontal and plane supporting surfaces for the sound-absorbing element has been found to be very advantageous especially in regard of the torque transmission from the skeletal support to the crankcase, because in this arrangement the sound-absorbing element is only pushed or pulled respectively but not simultaneously loaded in shear when using curved supporting surfaces. This enables to reach a higher durability of the sound-absorbing element on the one hand, and on the other hand more freedom in regard to the choice of the rubber hardness is achieved.

According to another embodiment of the invention especially effective noise reduction can be gained in that the supporting surface of the skeletal support is provided on a flange, said flange being cast integral with the outer water jacket of the cylinders in the range of the water space. By this construction advantage of the sound-absorbing effect of the water jacket can be taken because in the range of the connection flange there is no direct connection to the inner sound stimulated cylinder wall.

In another arrangement the rubber or plastic made sound-absorbing element which simultaneously also serves as an oil seal for the crankcase may be at least with one of its seating surfaces directly mounted, for instance by means of an adhesive. This enables to avoid thermal stress which may result at sound-absorbing elements which are built up by one or two metallic frames and a continous flexible element vulcanized to said frames and which stress can cause loosening of the flexible element. In this connection the provision of the horizontal and plane supporting surfaces is advantageous too because also for the adhesive joint a push and pull loading is more propitious. A suitable adhesive for the sound-absorbing element has to be resistant against oil and heat. These requirements are met for instance by silicone-rubber-adhesives.

According to a further feature of the invention the sound-absorbing element is directly mounted with its both seating surfaces, for instance by means of an adhesive, whereby the bottom of the crankcase is open over the whole length and breadth and in per se known manner closed with a detachable cover. Thermal stress can be hereby safely precluded and the mounting of the crankshaft right up from below can be easily carried out. Like at the preceding embodiment also in this case the arrangement of horizontal and plane supporting surfaces is advantageous in respect for the strain of the adhesive joints. Besides of this it is easier to attach the rubber element by means of adhesives on horizontal planes, especially with an element which consists of a relatively soft rubber or plastic material.

DESCRIPTION OF THE DRAWINGS

An exemplary embodiment of an internal combustion Vee-engine according to this invention will now be described with reference to the accompanying drawings wherein.

DESCRIPTION OF THE PREFERRED EMBODIMENT

Figure 1:
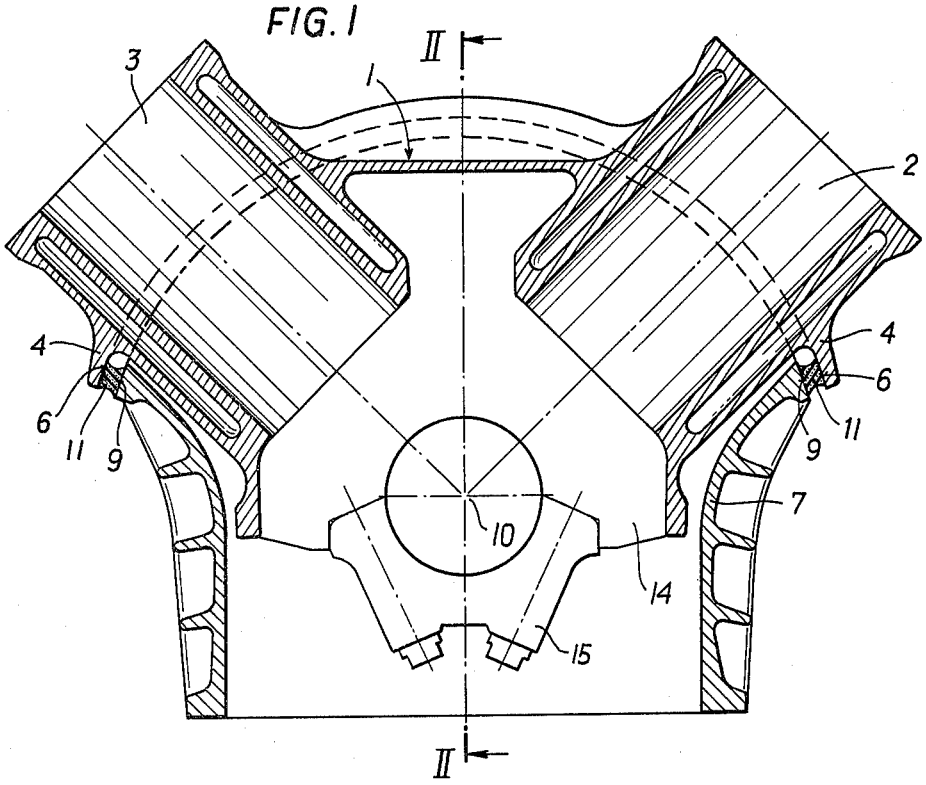
FIG. 1 is a cross section of a Vee-engine, FIG. 2 a longitudinal section according to line II—II in FIG. 1, FIG. 3 a cross section of a Vee-engine in another embodiment, FIG. 4 again a longitudinal section according to line IV—IV in FIG. 3, and FIG. 5 a detail of a further embodiment according to FIG. 3 on larger scale.
Figure 2:
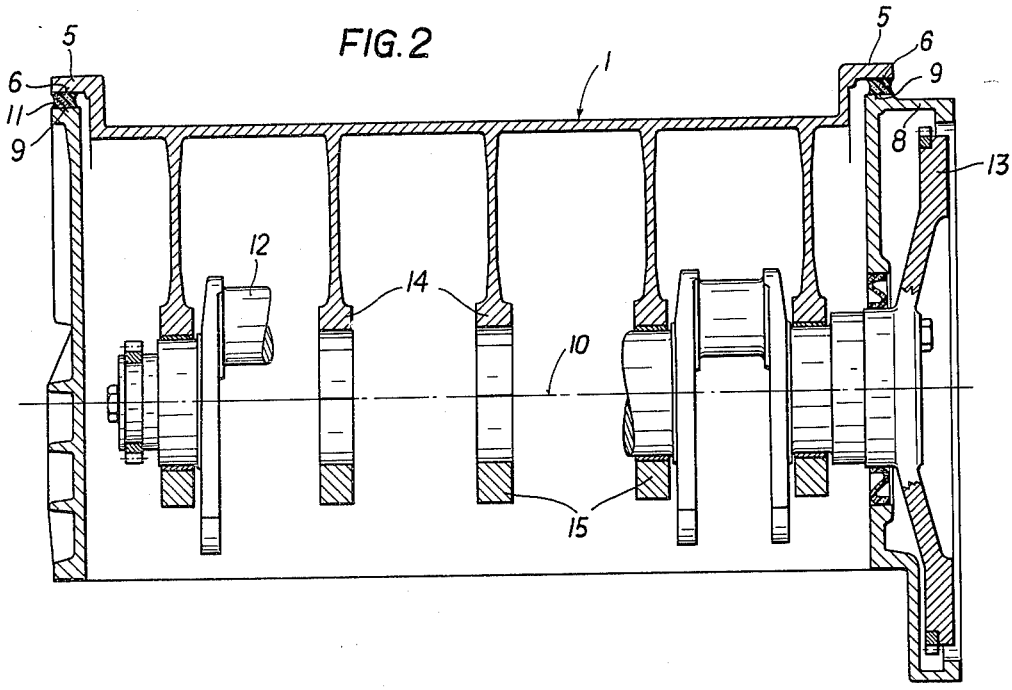

The skeletal support 1 consists of two Vee-arranged cylinder lines 2, 3 and is cast in one piece. At the outer sides of the cylinder lines 2 and 3 flanges 4 are provided, which extend to the frontal sides and form cylindrical supporting surfaces 6, said surfaces simultaneously being sealing surfaces. Said supporting surfaces 6 continue as plane surfaces in longitudinal direction on both sides of the engine. On the crankcase 7, including the flywheel casing 8, corresponding supporting surfaces are extending in the longitudinal direction of the engine and cylindrical surfaces 9 are provided, the axes of which are identical with the axis 10 of the crankshaft 12. Between the supporting surfaces 6, 9 a sound through solids absorbing resilient element 11 is provided which also serves as an oil seal for the crankcase 7. The resilient element 11 for instance consists of rubber or of elastic plastic material and is at least on one of its both seating surfaces 6, 9 directly mounted, for instance by means of an adhesive. Attachment of the resilient element therefore is possible in simple manner without using a certain mould or heat.

Figure 3:
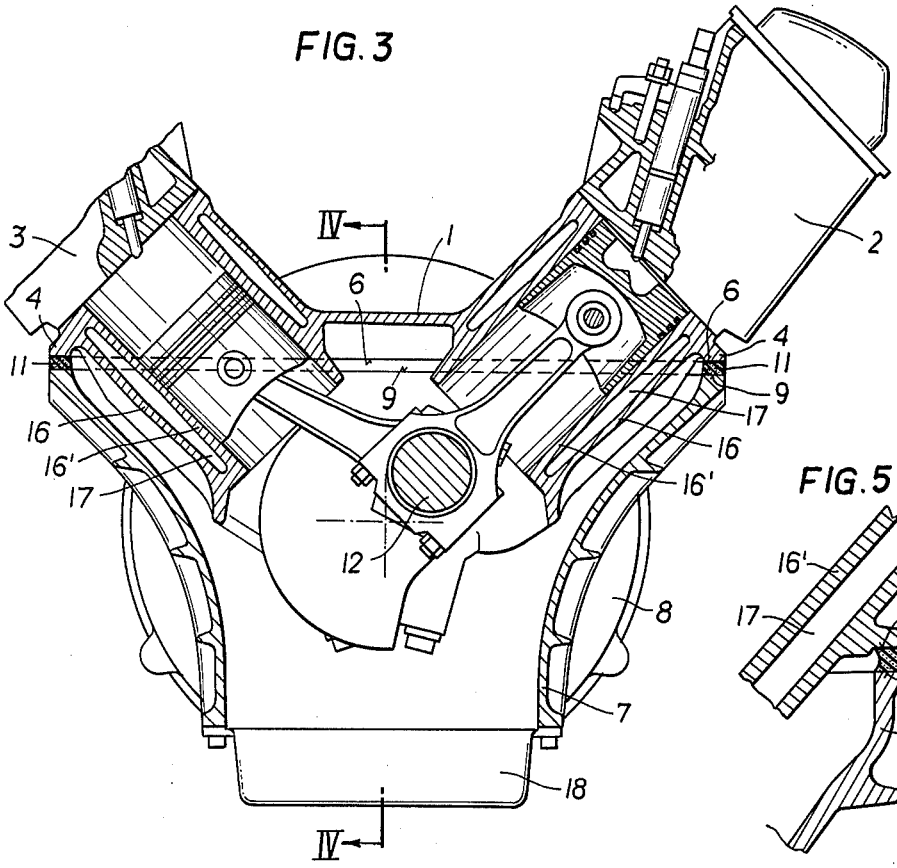
Figure 4:
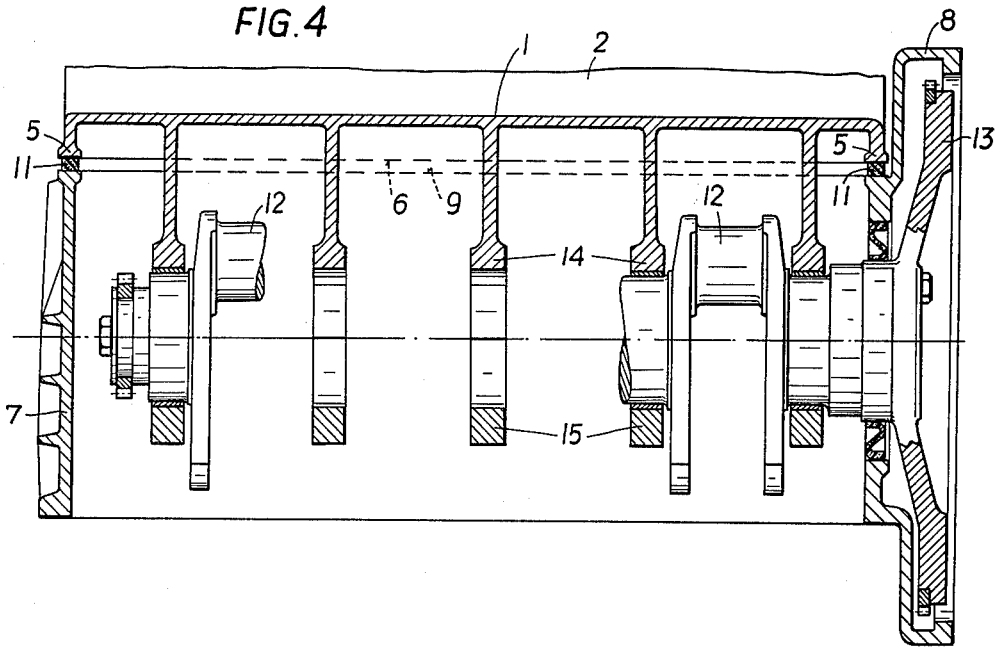

At the embodiment according to FIGS. 3 and 4 the flange 4 or 5 respectively form a plane supporting surface 6 surrounding the skeletal support simultaneously serving as a sealing surface. At the crankcase 7 and the flywheel casing 8 a corresponding supporting surface 9 is arranged, extending in the longitudinal direction and continuing at the frontal side of the engine. In between the supporting surfaces again a continuous sound-absorbing resilient element 11 is provided which also serves as a sealing. In the case the resilient element 11 is attached on its both seating surfaces by means of an adhesive the bottom of the crankcase 7 is open to enable the mounting of the crankshaft 12. This aperture is closed in the usual manner by a cover 18.

Parts of the engine which are not essential for the invention are not shown. The ruptured designed crankshaft is marked with 12 and the flywheel with 13. The crankshaft 12 is supported in main bearings 14 with screwed bearing caps 15.

Figure 5:
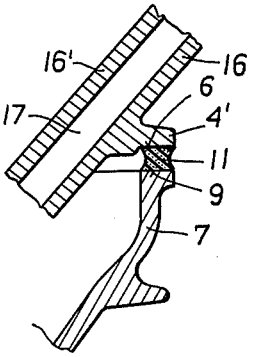

At the embodiment according to FIG. 5 the flange 4' is provided between the upper and lower end of the cylinders at the outer water jacket 16. So the flange 4' is in a range with no direct connection between the inner cylinder wall 16' and the outer water jacket 16 and advantage can to taken of the sound-absorbing effect of the water space 17.

We claim:

1. A low-noise-level internal combustion Vee-engine, comprising a crankshaft and crankshaft main bearings which are engine parts directly affected by body resonance and sound vibration, a skeletal engine unit support which supports said crankshaft main bearings, a cylinder head mounted on said engine unit support, auxiliary units rigidly connected to the engine unit support and to a cylinder head, a crankcase and a flywheel case connected with the crankcase, and at least one sound-absorbing element located above the crankshaft between said engine parts which are directly affected by sound vibration and said crankcase and flywheel case, connection between the skeletal support and the crankcase with the sound-absorbing element being made by means of a supporting surface arranged at and surrounding the skeletal support and a counter surface arranged at and surrounding the crankcase, both areas being plane in the range of the longitudinal sides of the crankcase and the skeletal support, and said supporting surface and said counter surface for the connection of the skeletal support and the crankcase at the front sides of said engine parts being formed as cylinder areas at the crankcase and corresponding cylindrical counter areas at the skeletal support, the axes of said cylinder areas extending in the engine's plane of symmetry and parallel to the crankshaft axis.

2. An internal combustion Vee-engine according to claim 1, wherein the axes of the cylinder areas and the crankshaft are identical.

3. An internal combustion Vee-engine according to claim 1, wherein said sound-absorbing element is made of rubber or plastic and having at least one of its seating surfaces directly mounted by means of an adhesive.

4. An internal combustion Vee-engine according to claim 1, the rubber or plastic made sound-absorbing element having at least one of its seating surfaces directly mounted by means of an adhesive.

* * * * *